United States Patent [19]

Levasseur et al.

[11] Patent Number: 4,848,582

[45] Date of Patent: Jul. 18, 1989

[54] SLIDING PACKAGE INCORPORATING AT LEAST ONE RETRACTABLE PANEL

[76] Inventors: Daniel Levasseur, 5 Allée Pierre Brossolette, 93320 Pavillons Sous Bois; Paul Poggi, 5 Rue de l'Avé Maria, 75004 Paris, both of France

[21] Appl. No.: 128,051

[22] Filed: Dec. 3, 1987

[30] Foreign Application Priority Data

Oct. 21, 1987 [FR] France ..... 87 14540

[51] Int. Cl.[4] ..... B65D 83/04

[52] U.S. Cl. ..... 206/534.2; 206/104; 206/110; 206/528

[58] Field of Search ..... 206/39.5, 39.6, 104, 206/110, 528, 532, 534.2

[56] References Cited

U.S. PATENT DOCUMENTS

| | | | |
|---|---|---|---|
| 819,574 | 5/1906 | Moore | 206/39.5 |
| 1,349,780 | 8/1920 | Martos . | |
| 1,961,344 | 6/1934 | Ecker, Jr. | 206/39.6 |
| 2,212,773 | 8/1940 | Gray . | |
| 2,737,290 | 3/1956 | Volckening et al. | 206/104 |
| 2,946,432 | 7/1960 | Poschman, III | 206/110 |
| 3,327,843 | 6/1967 | O'Meara et al. | 206/534.1 |
| 3,452,860 | 7/1969 | Milani | 206/110 |
| 3,530,977 | 9/1970 | Ungarsohn | 206/110 |
| 4,090,605 | 5/1978 | Walker, Jr. | 206/110 |
| 4,192,422 | 3/1980 | Kotyuk | 206/528 |
| 4,535,890 | 8/1985 | Artusi | 206/532 |

*Primary Examiner*—David T. Fidei

*Attorney, Agent, or Firm*—Young & Thompson

[57] ABSTRACT

A package for articles such as matches, medication in tablet form and the like comprises a flat pocket made up of a foldable element and one or more retractable panels. Each retractable panel is able to assume a deployed position in which an article in the package is visible and accessible and an undeployed position in which the article is invisible and inaccessible. The flat pocket comprises a front flap and a rear flap, each retractable panel is attached to but movable relative to the front or rear flap and the articles in the package are distinct from each retractable panel.

36 Claims, 6 Drawing Sheets

SLIDING PACKAGE INCORPORATING AT LEAST ONE RETRACTABLE PANEL

BACKGROUND OF THE INVENTION

1. Field of the Invention

The present invention concerns a sliding package incorporating at least one retractable panel.

A package of this kind is adapted to contain an article of any kind to which access is available or not depending on the position of a retractable panel. The article in question may comprise a plurality of matches and an abrasive surface for striking them or medication, pastilles or any other pharmaceutical and/or foodstuffs product, etc.

2. Description of the Prior Art

It is already known to provide matches and an abrasive pad for striking them (hereinafter referred to as a striker) in a book type package. The book of matches generally comprises a retractable flap that has to be turned back to obtain access to the matches and their striker. Thus an extremely important safety condition is not met in that the striker is accessible only when the matches are also accessible. Thus on striking a match it is possible that other matches will ignite at the same time.

Another serious inconvenience of these known packages for matches is that they are easily opened by a child, as it is only necessary to turn back a flap.

Moreover, once a few matches have been used the hinged flap providing access to the matches is often damaged and does not close properly, which once again compromises the safety of such matchbooks.

An object of the present invention is to remedy all these disadvantages and to provide a package which is safer in use and easy and economical to manufacture.

The package in accordance with the present invention is also suitable for containing articles such as medication.

Many medications are currently sold as tablets packed under a plastic film on a backing sheet, each tablet being detached through the backing sheet independently of the others. Tablets packed in this way (referred to hereinafter as cards) are usually sold in a cardboard box or similar type traditional container. A leaflet giving instructions for use and indicating the dosage is also placed inside this box.

This form of packaging has many disadvantages, however.

For one thing, it is easy for children to open the package as it is in the familiar form of a box.

For another thing, once the box of medication has been opened a number of times the leaflet tends to be jammed, crumpled or torn in the far end of the box or, worse still, thrown away as it prevents the box being closed. Consequently, any medication packaged in this way can end up without any dosage instructions, which is extremely dangerous.

An object of the present invention is to overcome all of these disadvantages and in particular to provide a form of packaging which, although easy to open for an adult, does not open in the traditional way and so frustrates any attempt by a child to open it, and in which the dosage instructions cannot be discarded, lost or damaged or impede closing of the package.

A further object of the invention is to provide a package that is easy and economical to manufacture.

SUMMARY OF THE INVENTION

The present invention consists in a package for containing an article, comprising a flat pocket consisting of a foldable element and at least one retractable panel able to assume a deployed position in which an article in the package is visible and accessible and an undeployed position in which said article is concealed and inaccessible, wherein said foldable member comprises a front flap and a rear flap, said at least one retractable panel is coupled to but movable relative to at least one of said front flap and rear flap, the article in said package being separate from but adapted to be fixed to said at least one retractable panel.

By virtue of these provisions the package in accordance with the invention is made safer, being resistant to opening by a child without making access to the article itself, whether matches or medication, difficult for an adult.

Also, a package of this kind makes it possible to include the dosage instructions in the package in a convenient way. Dosage instructions forming an integral part of the package and/or forming an integral part of the medication card represent an improvement in safety. Also, the package obtained in this way is easy to manipulate and economical to manufacture.

Other objects, characteristics and advantages of the invention will emerge from the following description given by way of example with reference to the appended drawings.

DESCRIPTION OF THE PREFERRED EMBODIMENTS

Figure 1:
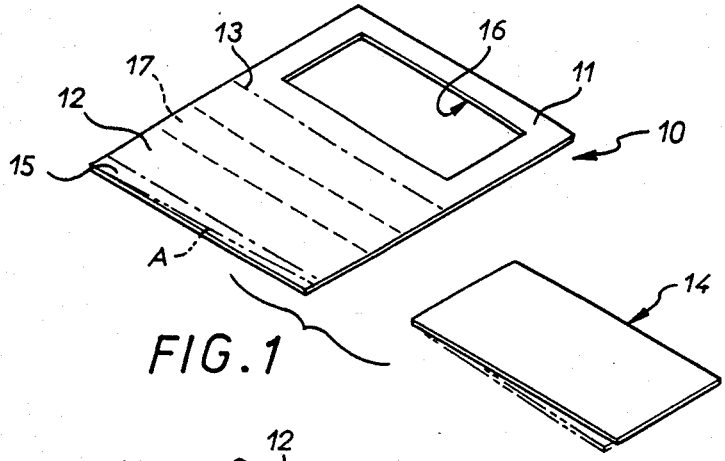
FIG. 1 is a view of a first embodiment of a package in accordance with the invention and comprising a retractable panel in an unfolded state.
Figure 2:
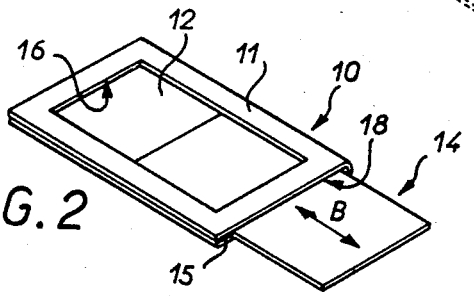
FIG. 2 is a view corresponding to FIG. 1 showing a package in accordance with the invention in a folded state.

In the embodiment shown in FIGS. 1 and 2, a package in accordance with the invention comprises a foldable element 10 comprising a front flap 11 and a rear flap 12 separated by a fold line 13 and a retractable panel 14. The rear flap 12 is provided with a fixing tab 15 while the front flap 11 features an opening 16.

As seen more clearly in FIG. 2, a package of this kind is made up by folding the front and rear flaps about the fold line 13. The tab 15 is folded over so that it lies between the two flaps and is fixed in this position. The retractable panel 14 is inserted between the front and rear flaps 11 and 12 and can be moved relative to the latter in the direction of the arrow B (FIG. 2) because the opening 16 provides direct access to the retractable panel 14.

In this embodiment the retractable panel 14 carries a plurality of matches and the flap 12 carries a striker 17 for the matches.

Note that in the embodiment described above the retractable panel can come out of the package, at least in part, by virtue of the opening 18.

The package described above has a generally rectangular shape, as has the opening 16. It will be understood that the package and the opening can have any shape.

Likewise, the position of the striker can differ from that described; the striker can be fixed to either the front or the rear flap and in any position thereon.

Note that the various components may be fixed to each other in any way.

To prevent the flap 14 escaping from between the front and rear flaps 11 and 12 the fixing tab may have a slanted edge as shown in chain-dotted line at A in FIG. 1, the flap 14 then having a complementary shape (also shown in chain-dotted line) and retaining means (not shown) to prevent it escaping completely from the space between the front and rear flaps.

Note that the foldable element 10 may differ from that described; for example, the front and rear flaps 11 and 12 may be joined along their width rather than along their length. In this case the opening 18 is formed along the length of the front and rear flaps.

In an alternative arrangement, described hereafter in connecting with FIGS. 5–21, the retractable panel may be fastened to one or other of the front and rear flaps, while being movable relative to them. In this case such fastening constitutes a simple way of retaining the retractable panel within the foldable element.

For example, either the front or rear flap could feature an internal cut-out provided with two abutments (not shown). A peg attached to the retractable panel then slides in the cut-out between the two abutments. The travel of the retractable panel is then limited by the positions of the two abutments.

Figure 3:
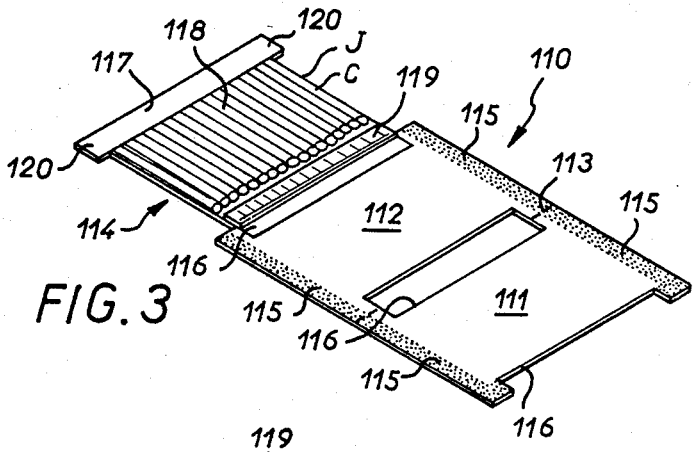
FIG. 3 is a view of a second embodiment of a package in accordance with the invention in the unfolded state.
Figure 4:
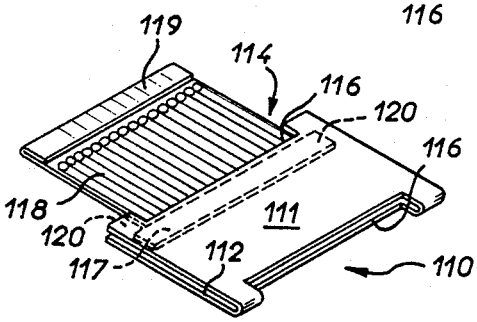
FIG. 4 is a view corresponding to FIG. 3 but in the folded state.

In a second embodiment shown in FIGS. 3 and 4 the package in accordance with the invention comprises a front flap 111 and a rear flap 112 joined at a fold line 113 and together constituting a foldable element 110 and also a retractable panel 114. The retractable panel is formed in the same strip of material as the two flaps previously mentioned. The panel carries on the same side a striker 117 and a plurality of matches 118. The flaps 111 and 112 are provided with pre-glued fixing tabs 115.

Openings 116 are provided on each side of each of the front and rear flaps 111 and 112. The retractable panel 114 is also provided with a strengthened gripping element 119 and is precut along broken lines C.

The strengthening of the gripping element 119 is advantageously achieved by folding over onto this element the material cut away to form the adjacent opening 116.

A package of this kind is assembled by cutting the retractable panel 114 along the broken lines C and folding this panel over onto the rear flap 112.

The pre-glued fixing tabs 115 are folded over into contact with each other and thus fastened together.

The retractable panel 114 can then slide between the fixing tabs 115 serving as slideways and preventing the retractable panel escaping from the space formed between the face-to-face front and rear flaps.

Note that for a package of this kind the broken lines C of the flap 114 constitute retaining means 120 which prevent the flap 114 escaping from between the two flaps 111 and 112 whilst allowing it to slide along the tabs or slideways 115.

Note also that in this embodiment the opening enabling the retractable panel to be pulled out, at least in part, is the opening 116.

The striker 117 is visible only when the retractable panel 114 is completely inserted between the front and rear flaps 111 and 112. This is important because it makes it impossible to strike a match unless the remaining matches are protected. In this way an important safety condition is met.

Alternatively, the previous package can be provided with a single opening 116 intended to facilitate gripping of the retractable panel 114. In this case the striker 117 is attached to the back of the front or rear panel 111 or 112.

The shape of the opening or openings 116 is immaterial, as are the dimensions of the package. However, the dimensions are preferably such that it is easy to hold the package in the hand.

Likewise the flap 114 need not have a broken line shape, in which case the package is provided with appropriate means for preventing the flap 114 escaping from between the front and rear flaps 111 and 112.

A package of this kind may be attached to and/or associated by any appropriate means with a pack of cigarettes.

Figure 5:
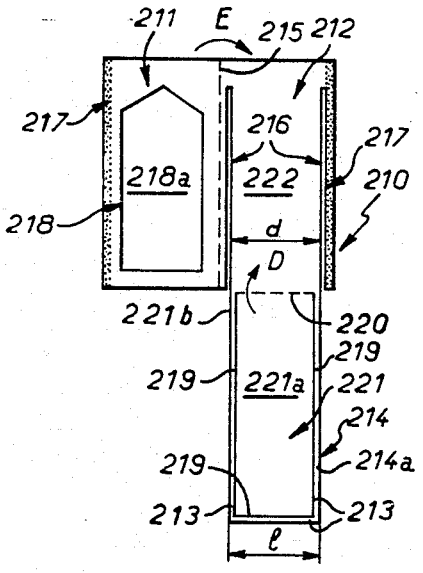
FIG. 5 is a plan view of a third embodiment of a package in accordance with the present invention.
Figure 6:
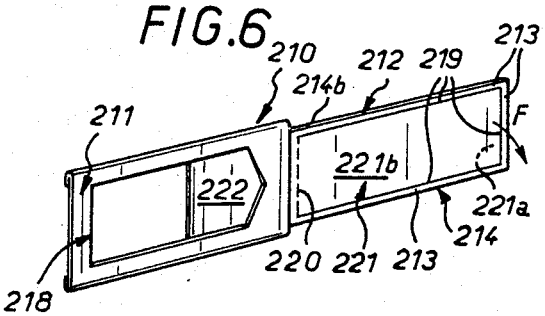
FIG. 6 is a perspective view of the FIG. 5 package in a deployed position.

In the embodiment shown in FIGS. 5 and 6, the package 210 in accordance with the invention has a front flap 211, a rear flap 212 and a retractable panel 214 all three of which are integral parts of the same blank. This package is more particularly intended to contain a medication, tablet or similar type article.

The front and rear flaps are the same size and are delimited by a fold line 215. The rear flap 212 comprises two symmetrical cuts 216 defining a central part or retaining tab 222. The retractable panel 214 is obtained by extending these cuts and has a width 1 identical to the distance d separating the cuts 216. The retractable panel 214 has a rectangular rim 213 and inside this a hinged panel 221 cut out within it along lines 219 on three sides with a fold line 220 on the other side. The hinged panel has on each of its sides 221*a*, 221*b* a surface on which can be printed the dosage instructions appropriate to the medication. The front and rear flaps 211 and 212 each have an appropriate glueing area 217.

The front flap 211 has a pre-cut window 218 but the material is not removed until the package is to be opened for the first time, providing a cover 218*a*.

A card of medication (not shown) is glued to the rectangular rim 213 of the side 214*b* of the retractable panel 214. This card comprises in the traditional way a semi-rigid plastic film having on one side cells containing tablets, pills, and the like and to the other side of which is attached an aluminum film closing off these cells.

In the known way the aluminum film is readily pierced at the location of each cell to provide easy access to the corresponding tablet.

The blank is assembled in the way now to be described.

The retractable panel 214, provided on its side 214*b* with a card of medication, is folded over onto the rear flap 212 as shown by the arrow D (FIG. 5). The front flap 211 is then folded over onto the rear flap 212 as shown by the arrow E so that the glueing areas 217 come together and stick together. This completes the package in accordance with the invention.

A package of this kind is used in the way now to be described.

Prior to use, the package in accordance with the invention is in the folded state (not shown). To enable the package to be opened it is first necessary to remove the cover 218*a* closing off the window 218. The user then applies pressure with his thumb to the retractable panel 214 seen through the window 218, causing it to slide out through one end of the package. The retractable panel 214 is then outside the package, and the hinged panel 221 can pivot about its fold line 220 in the direction of the arrow F (FIG. 6). The dosage instructions concerning the medication fixed to the hinged panel 221 can then be read on both sides thereof. If the user wishes to take one or more of the tablets packaged on the card fixed to the side 214*b* of the retractable panel 214 he need only turn back the hinged panel 221 to obtain access to the rear surface of the card and pierce it (in the usual way) to extract the tablet or tablets needed.

To close the package in accordance with the invention it suffices to push the retractable panel 214 into the package, the hinged panel then automatically closing into a flattened position inserted between the front and rear flaps.

Note that because of the retaining tab 222 the retractable panel cannot be taken completely out of the package or detached therefrom, and this applies equally to the card and the hinged flap carrying the dosage instructions.

What is more, although a package in accordance with the invention is easy to open for an adult, a child is not able to open it since, in order to deploy the retractable panel 214, it is necessary to exert a pressure and a sliding motion at the same time. Also, access to the medication is prevented by the fact that the hinged flap has not been raised.

Note that the areas of the package available for printing the dosage instructions or other information concerning the medication are not limited to those of the hinged panel 221 only. The retaining tab 222 is also visible in the window 218 and can be printed, as can the outside surface of the package.

There is obtained in this way a secure, economical and simple package in which the card of medication is attached to the package and in which the dosage instructions cannot become separated from the card of medication and cannot impede correct closing of the package.

A package of this kind may be made from any appropriate material such as cardboard, plastic, etc.

FIGS. 7 through 12 show a fourth embodiment of the present invention which is remarkable notably in that an additional flap is provided to cover the rear flap so that the user does not see the movement of the retaining tab, which improves not only the appearance but also the strength of the package. Elements of this fourth embodiment common to the third embodiment carry the same reference numbers increased by 100.

The package 310 in this embodiment comprises a front flap 311, a rear flap 312, a cover flap 330 and a retractable panel 314 with appropriate glueing areas 317. A fold line 320 delimits the rear flap 312 from the retractable panel, a fold line 315 delimits the rear flap 312 from the front flap 311 and a fold line 325 delimits the front flap 311 from the cover flap 330.

The cover flap 330 has a glueing area 317 delimited by a fold line 331.

A package of this kind is folded in the way now to be described.

Figure 7:
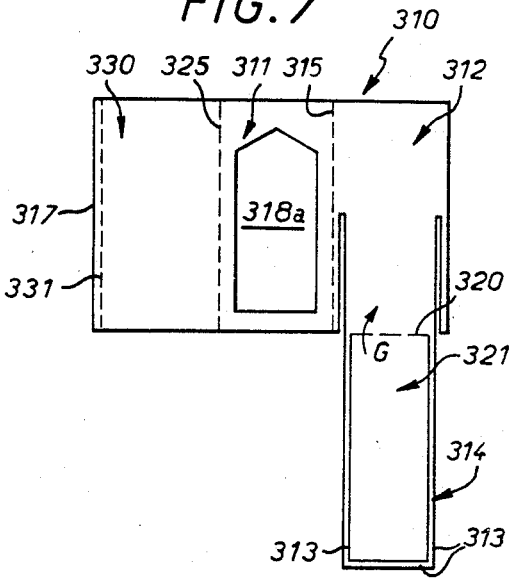
FIGS. 7, 8 and 9 are plan views of a fourth embodiment of a package in accordance with the invention showing successive stages of folding it.
Figure 8:
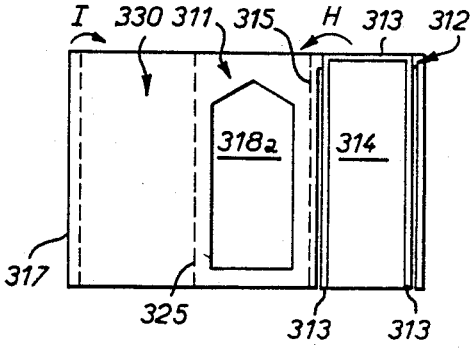

The retractable panel 314 comprising its hinged panel 321 surrounded by the rectangular rim 313 is folded over onto the rear flap 312 as shown by the arrow G (FIG. 7). The flap 312 and the retractable panel 314 are then folded over onto the front flap 311 as shown by the arrow H (FIG. 8). The glueing area 317 of the cover flap 330 is then folded over onto the latter as shown by the arrow I so that the pre-glued part is not in contact, after bending about the bend line 331, with the cover flap 330.

The rear surface of the rear flap 312 is advantageously provided with another glueing area 317 such that as a result of bending in the direction of the arrow K (FIG. 9) the two glueing areas 317 come together and stick to each other.

Figure 11:
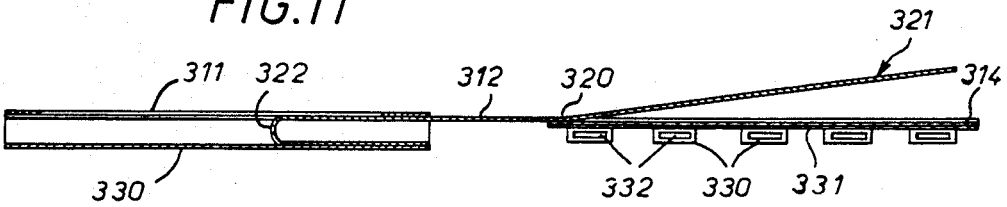
FIG. 11 is a view in cross-section on the line XI—XI in FIG. 10.

This completes the package in this embodiment. The only difference between the third and fourth embodiments is that the package of the fourth embodiment is provided with a cover flap 330 covering the rear flap 312. FIG. 11 shows a card 331 of medication carrying tablets 332 visible through a transparent plastics film 333.

Figure 10:
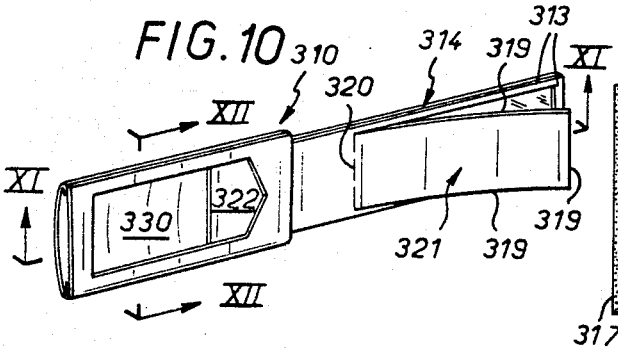
FIG. 10 is a perspective view of the package of FIGS. 7 through 9 in the deployed position.
Figure 9:
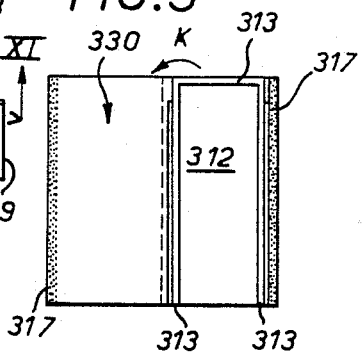
Figure 12:
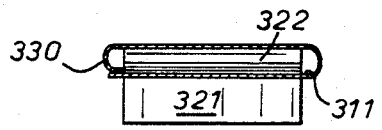
FIG. 12 is a view in cross-section on the line XII—XII in FIG. 10.

This fourth embodiment functions in a similar way to the third embodiment which will not be described again here, but is clearly illustrated in FIGS. 10 through 12. Note that by virtue of the presence of the cover flap 330 the external esthetic appearance of the package in accordance with the invention is significantly improved, as is its strength. What is more, additional surfaces that can be printed are thus provided.

Figure 13:
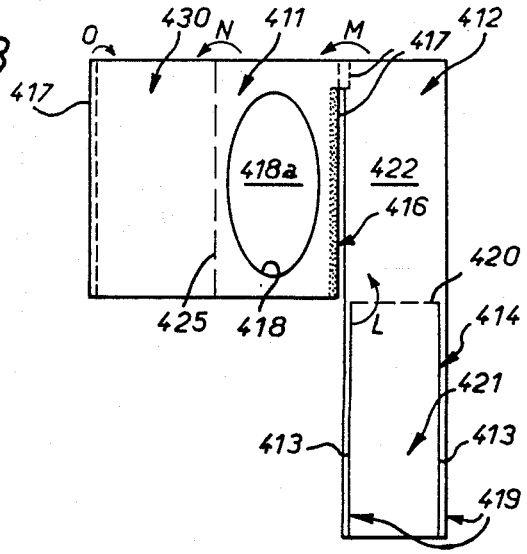
FIGS. 13 and 14 are plan views of two variations on the fourth embodiment of the invention.
Figure 14:
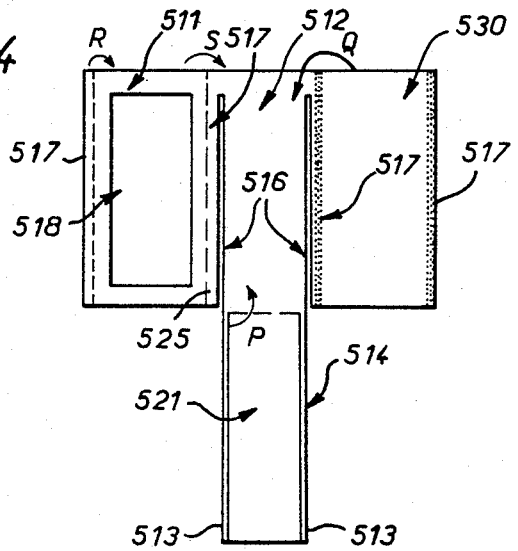

FIGS. 13 and 14 show a number of variations on the fourth embodiment which could equally well be adopted for the third embodiment.

In FIG. 13 in particular the window 418 is of oval shape and the retaining tab 422 is obtained by making a single cut 416 rather than two cuts. The other side of the retaining tab is formed directly by the outside edge of the rear flap 412. The hinged panel 421 is obtained by cutting inside the edges 413 of the retractable panel 414 along two lines 419 and is delimited by a fold line 420.

The transverse cutting line on the retractable panel 414 at the opposite end from the fold line 420 is eliminated.

Appropriate glueing areas 417 are provided on the rear surface of the flap 412, on the front surface of the flap 411 and on a glueing area that can be folded over onto the flap 430. A package of this kind is folded in a similar way to that described previously and as shown by the arrows L, M, N and 0. Its use is unchanged.

FIG. 14 shows another variation on the package in accordance with the invention in which the retractable panel 514 comprising its edges 513 and its hinged panel 521 is aligned with the rear flap 512 provided with appropriate cuts 516.

In this embodiment the rear flap 512 is between the front flap 511 and the cover flap 530. Appropriate glueing areas 517 are provided on each of the front, rear and cover flaps. A rectangular shape window 518 is formed in the front flap 511. The package in this embodiment is folded as shown by the arrows P, Q, R and S.

Note that the arrow Q indicates that the cover flap 530 is folded over onto the rear surface of the rear flap 512 whereas the front flap 511 is folded over (arrow S) onto the combination formed by the rear flap 512 and the retractable panel 514, so that the rear flap 512 lies between the front and cover flaps.

FIGS. 15 through 19 show another variation on the fourth embodiment.

The package 610 in this variation on the fourth embodiment comprises in succession along the length of the blank a retractable panel 614, a rear flap 612, a front flap 611 and a cover flap 630. Transverse fold lines 626, 615 and 625 delimit the successive flaps and panels from each other.

As in all previous embodiments, the retractable panel 614 has a rectangular rim 613 and inside this a hinged panel 621 cut out within the retractable panel along lines 619 on three of its sides with a fold line 620 on its fourth side.

The retractable panel 614 is obtained by extending the longitudinal cuts 616 made symmetrically in the rear flap 612. In this way a longitudinal margin is obtained on the longitudinal edges outside the cuts 616. These longitudinal margins extend from the free end of the rear flap 612 to the free end of the cover flap 630 via the front flap 611. All or part of the margins on at least one side of the blank are pre-glued, for example at 617 on the longitudinal margins of one side of the front flap 611 and of the cover flap 630.

Unlike the other embodiments, in this embodiment the fold line 620 about which the panel 621 pivots is not coincident with the fold line 626 delimiting the retractable panel from the retaining tab defined by the rear flap 612. Similarly, the fold line 626 is not aligned with the free end of the rear flap but is at a certain distance inside the longitudinal limit of the rear flap.

A window 618 straddles the fold line 615 and cuts into the rear flap 612 and also the front flap 611, not just the front flap as in the embodiments previously described. The transverse dimension of the window 618 is slightly greater than the width of the retractable panel 614 and in practise identical to the distance between the outside edges of the cuts 616 in the rear flap 612. The window 618 constitutes two half-windows 618A, 618B in the rear and front flaps, respectively. At the free end of the cover flap 630 is a cut-out 618C substantially identical to the half-window 618B in the rear flap 612.

Figure 15:
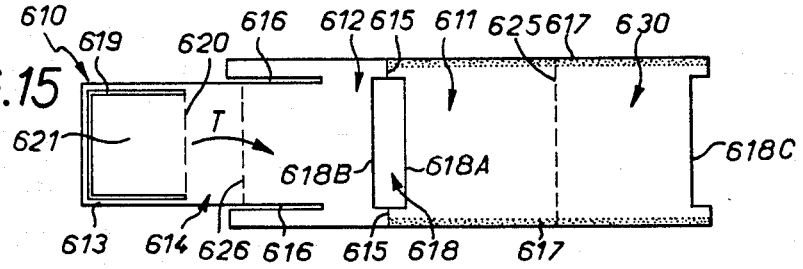
FIGS. 15 through 18 are plan views of another variation on the fourth embodiment showing successive stages of folding it.

To assemble the blank 610 of FIG. 15 there are three folding operations, as in the other variations on the fourth embodiment. However, in this variation the folding is effected about three parallel transverse fold lines 626, 615, 625 as shown in FIGS. 11 through 19.

Figure 16:
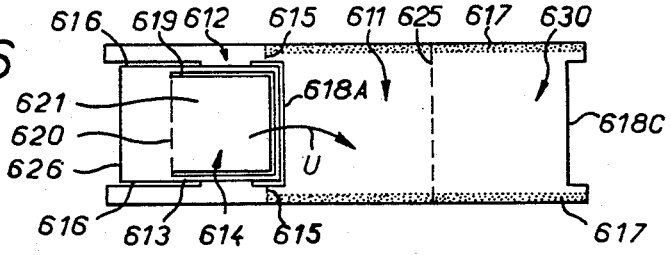

Firstly, the retractable panel 614 is folded about the fold line 626 in the direction indicated by the arrow T in FIG. 15 to the position shown in figure 16. Note that in this position the fold line 626 is offset inside the free end of the margins of the rear flap 612 and the free transverse edge of the rectangular rim 613 lie just inside the edge of the half-window 618A.

Figure 17:
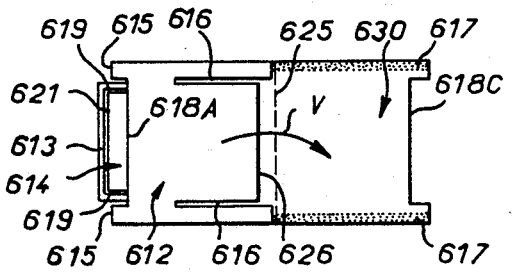

Secondly, the retractable panel 614 and the rear flap 612 are folded together about the fold line 615 passing through the window 618, in the direction indicated by the arrow U in FIG. 16, to the position shown in FIG. 17. In this position the free ends of the margins of the rear flap are disposed slightly short of the fold line 625 to facilitate the remaining folds.

Figure 18:
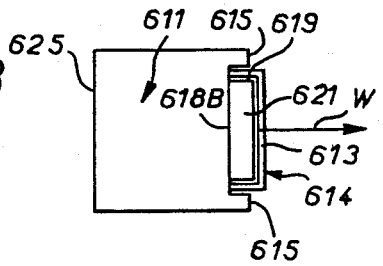
Figure 19:
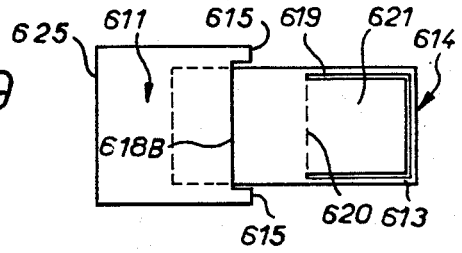
FIG. 19 is a plan view of the package of FIG. 18 in the deployed position.

The third fold is about the fold line 625 in the direction indicated by the arrow V towards the closed or retracted position of the package shown in FIG. 18. Note that the free end of the retractable panel extends beyond the free end of the margins of the front flap 611. Because of the half-window 618B on the side of the package visible in FIG. 18 and the half-window 618A and the cut-out 618C on the other side, which are not visible in FIG. 18, the free end of the hinged panel is accessible and can therefore be gripped between the fingers of the user and pulled in the direction indicated by the arrow W to move the retractable panel to the deployed position shown in FIG. 19. As in the other embodiments the card of medication is adapted to be fixed to the rim 613 of the retractable panel. Thus the card will project slightly in the deployed position of the package 610 in which the hinged panel 621 is flattened out and inserted between the flaps 611 and 612.

Even so, this embodiment offers a good degree of security against deployment of the retractable panel by a young child. The user has to grip the end of the retractable panel between his fingers and pull in the direction of the arrow W in FIG. 18 while at the same time gripping the front flap 611 and the cover flap 630 in the other hand.

The embodiment of FIGS. 15 through 19 is extremely easy to assemble because all of the assembly operations are accomplished by folding in the same direction and about parallel transverse fold lines.

To adapt this variation to the third embodiment it is necessary to eliminate the cover flap; the free transverse end of the front flap can then be provided with a cut-out like the cut-out 618C or not, as required.

Figure 20:
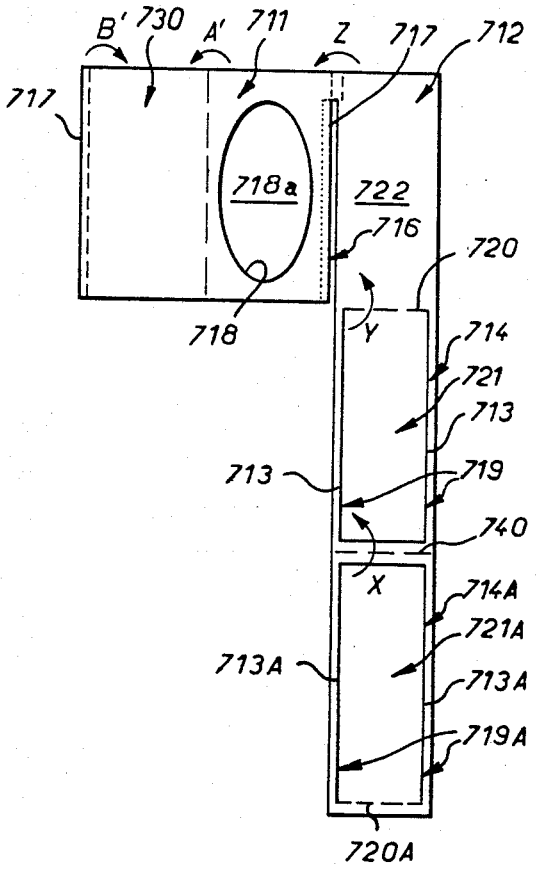
FIG. 20 is a plan view of an embodiment with two retractable panels.
Figure 21:
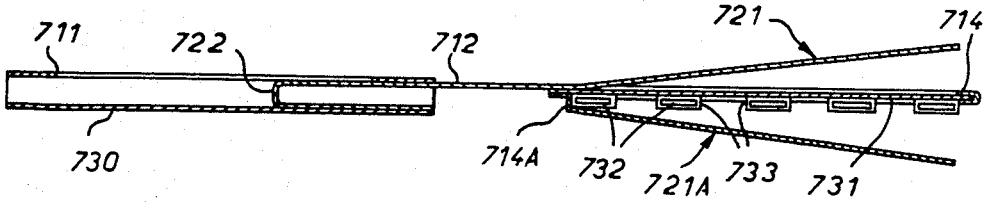
FIG. 21 is a view of the FIG. 20 package in the deployed position.

FIGS. 20 and 21 show a further development of the embodiment from FIG. 13 that can, however, be adopted for any other embodiment.

The reference numbers for the component parts begin with the hundreds digit 7, the last two digits of each reference number corresponding to those of the FIG. 13 embodiment.

In this embodiment two retractable panels 714, 714A are provided, the second 714A being continuous with the first 714 and delimited from it by a transverse fold line 740.

The first and second retractable panels 714, 714A are in all respects similar and the two panels are symmetrical relative to the fold line 740. Each hinged panel 721, 721A is obtained by cutting within the rim 713, 713A of the retractable panel 714, 714A along longitudinal cutting lines 719, 719A and delimited by a fold line 720, 720A. The fold line 720A is adjacent the free end of the retractable panel 714A and the corresponding fold line of the retractable panel 714 delimits the first retractable panel 714 from the rear flap. Other arrangements of the fold lines are possible to enable the hinged flaps 721, 721A to hinge in the same or opposite directions.

The blank is folded in a similar way to that of FIG. 13, except that the second retractable panel 714A is initially folded in the direction of the arrow A about the fold line 540. Then both retractable panels are folded around the fold line 720 in the direction of the arrow Y so that the second retractable panel lies opposite the rear flap 712. The flaps 712, 714, 714A are then folded about the fold line in the direction indicated by the arrow Z so that the first retractable panel faces the front flap 711 and is therefore exposed through the oval window 718 closed off by a cover 718*a*. The glueing area 717 for glueing the rim 713 corresponds to that of the first retractable panel 714. The combination of the flaps 711, 712, 714, 714A is then folded on the fold line delimiting the cover flap 730 and the front flap 711 in the direction indicated by the arrow A'. Finally, the glueing area 717 on the free edge of the cover flap 730 is folded in the direction indicated by the arrow B' to glue the opposite rim 713 of the first retractable panel 714. The surfaces of the rims 713, 713A adapted to come together can advantageously be pre-glued also, of course.

A card of medication 731 or other article to be packaged is inserted between the rims of the retractable panels 714, 714A before folding over of the flaps is commenced.

This package functions in a similar way to the previous embodiments.

FIG. 21 shows the deployed position of the FIG. 20 package to illustrate the arrangement of the retractable panels 721, 721A one on each side of the card 731 of medication. Since the hinged panel 721A of the second retractable panel has to fit around the bubbles in the plastics film 732 containing the tablets 733 or other articles, its free end is set back slightly relative to the free end of the hinged panel 721 if the retractable panels 714, 714A are of the same length.

With this arrangement of the hinged panels 721, 721A four surfaces can carry information, in particular dosage instructions for the medication.

According to the embodiment illustrated in FIGS. 22 to 25 the package 810 comprises two parts. A first part comprises a front flap 811 and a rear flap 812 separated by a fold line 825. A second part comprises two retractable panels 814 and 814A separated by a fold line 820. Each retractable panel 814, 814A comprises a hinged panel 821, 821A and a rim 813, 813A. Each hinged panel 821, 821A is connected to its associated retractable panel 814, 814A by a fold line 850, 850A remote from fold line 820, 820A. Note that in the context of this embodiment the second part comprising the two retractable panels is separate from the first part comprising the front and rear flaps 811, 812.

Each front and rear flap 811, 812 is provided with a slot type transverse opening 840, 840A and a cutout 818, 818A in the adjacent transverse edge for gripping the rims. Fixing tabs 815 are provided on both longitudinal sides of one of the front and rear flaps, for example the front flap 811 as illustrated. The openings 840, 840A are designed such that their length D is slightly greater than the width b of the hinged panels 821, 821A.

Such a two part package blank can be assembled in the manner which will now be described.

The two retractable panels 814, 814A are folded over towards each other, around fold line 820 as indicated by arrow L'. The rims 813, 813A of the two retractable panels 814, 814A are fixed together, e.g. by glue.

Figure 23:
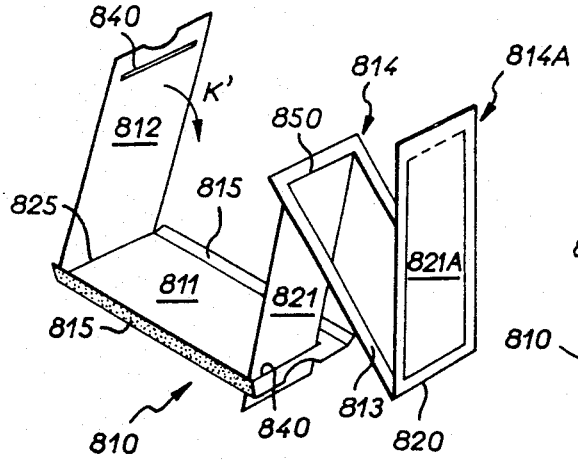
FIG. 23 is a perspective view showing an assembly step of the package of FIG. 22.
Figure 22:
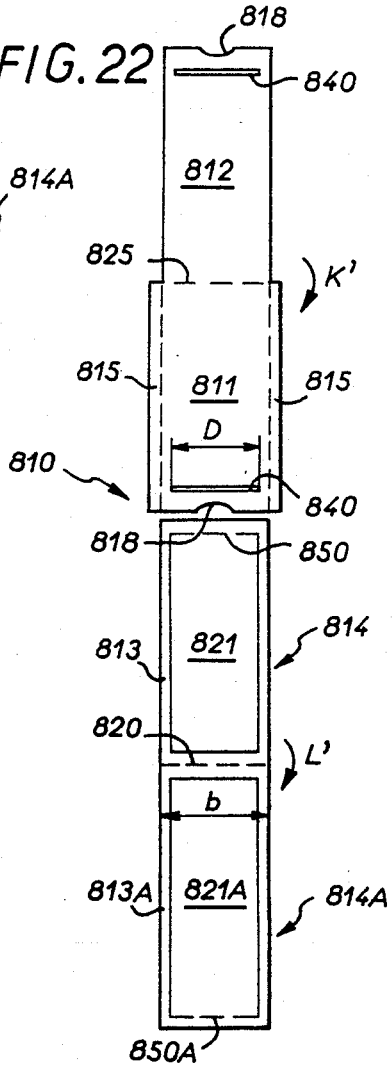
FIG. 22 is a plan view of two parts of a package blank according to a fifth embodiment of the invention.
Figure 24:
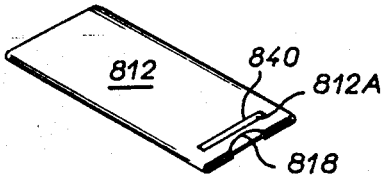
FIG. 24 is a perspective view of the rear side of the assembled package.

Each of the hinged panels 821, 821A is deflected out of the general plane of its associated retractable panel 814, 814A. The free end of each one of the hinged panels 821, 821A is then inserted into the corresponding opening 840, 840A (see FIG. 23). The front and rear flaps 811, 812 are then folded towards each other in the direction of arrow K' by pivotal movement about the fold line 825 as shown in FIG. 23. The fixing tabs 815 are folded inwardly of the package so as to permit the fixing of the front flap to the rear flap 812 with the folded second part therebetween. The second part is then pushed longitudinally completely inside the package. Note that in this position the free ends of each of the hinged panels 821, 821A traverse and project slightly beyond the openings 840, 840A but fall short of the cut-outs 818, 818A in the free transverse edges, which remain uncovered as illustrated in FIG. 24. Of course an article to be packaged is fixed, prior to folding, to the rims 813, 813A of the retractable panels 814, 814A and thus sandwiched between these rims.

Figure 25:
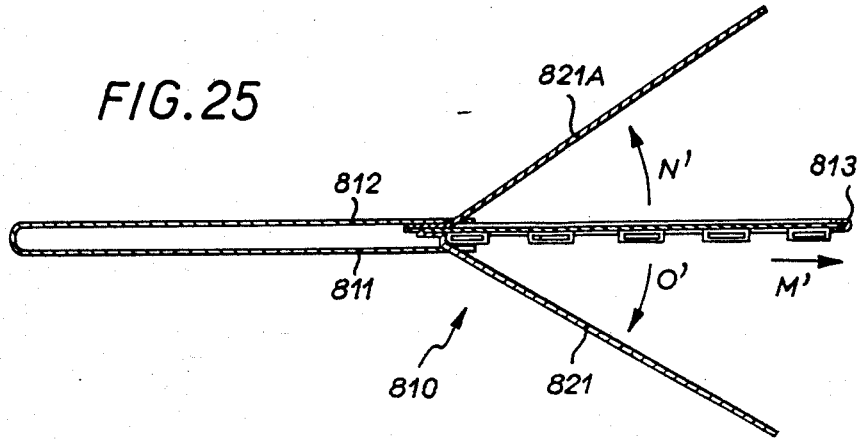
FIG. 25 is an elevational view of the assembled package of FIG. 22 showing the automatic opening of the hinged panels.

For such a package the ends of the retractable panels 814, 814A accessible through the cut-outs 818, 818A are grasped and pulled so that the retractable panels protrude fully outside the front and rear flaps 811, 812 respectively, as illustrated in FIG. 25.

Each of the hinged panels 821, 821A is progressively swung open in the direction of arrows N' and O' from the general plane of the package in the course of displacement of the hinged panels through the respective openings 840, 840A, as a function of the position of the fold lines 850, 850A relative to the outer edge of the opening.

In the fully swung position in FIG. 26, the outer edges of the openings 840, 840A abut the fold lines 850, 850A to define retaining means for arresting the movement of the retractable panels 814, 814A. It will be understood that the same combination of elements ensures both the automatic opening of the package and the retention function in this embodiment.

With the embodiment of FIGS. 22 to 25 savings of sheet material may be realized owing to the fabrication of the first and second parts from a single strip of sheet material of substantially constant width. The first and second parts of the package blank are severed from each other at the time the various openings, cut-outs and fold lines are punched.

The fixing tabs 815 on one or both of the front and rear flaps may be of any desired shape and size.

An opening 840, 840A may be provided in only one of the front and rear flaps for only one retractable panel. The opening or openings may be of any desired shape and size in cooperation with the shape and size of the associated retractable panels which are slidable therethrough. Moreover access windows may be provided in the retractable panels such as those described in preceding embodiments.

In lieu of the slot type openings 840, 840A illustrated the openings may be defined by perforations or score lines of corresponding configuration adapted to be pressed or torn out of the front and rear flaps prior to the first use of the package. Once the cover portions are pressed out or torn out of the corresponding flaps, the free ends of the hinged panels may be grasped and pulled through the thus formed openings. Such a modified package will have the advantage of anti-tamper means which will also act as a deterrent to a child's access to the contents of such a package. Similarly the cut-outs in the edges of the flaps may be press-out portions.

The retractable panels have a width slightly less than that of the front and rear flaps to permit free swinging movement therein.

The just described embodiment is also particularly advantageous owing to the reduced number of fold lines compared with the preceding embodiments.

It is to be understood that numerous other variations are possible with regard to the overall shape and size of the package and the shape and size of the window providing access to the retractable panel.

Likewise, the retaining tab can be of any shape and size and can also be reinforced, for example, as can the hinged panel.

Note that the package in accordance with the invention has a large surface area for printing on, but that this can be further increased by fixing to the rear of the hinged panel a folded sheet providing additional printing area. A folded sheet of this kind does not have the disadvantages of the traditional information leaflet, since it is fixed and in no way impedes closing of the package.

It is to be understood that the present invention has been described in an application serving as a package for articles such as medication but can also be used to package any type of article, internally packaged separately or otherwise on a rigid or otherwise card. Note that the larger are the cuts 216, 316, 416, 516, 616, 716 in the front flap the larger and therefore the stronger is the resulting retaining tab, while preventing complete withdrawal of the retractable panel 214, 314, 414, 514, 614, 714 so that the latter is retained in the package in accordance with the invention.

Likewise, the resulting package can be of greater or lesser thickness, to contain articles of greater or lesser size.

However, the package in accordance with the invention has dimensions such that is can be easily held in the hand by a user.

With a view to economising on the material from which the third and fourth embodiments of the package in accordance with the invention are made, a blank may be used in which the cover flap is under the front flap and not to the side. The fold line between these two flaps is moved in consequence of this. In this way it is possible to use a constant width of material for the blanks and to obtain packages without wasting material through subsequent cutting out. Each blank may be disposed head-to-tail with an adjacent blank.

It is to be understood that numerous variations can be envisaged without departing from the scope of the invention; for example, the hinged panel can be on the front or the rear surface of the retractive panel.

We claim:

1. Package for containing an article comprising a flat pocket consisting of a foldable element and at least one retractable panel able to assume a deployed position in which an article in the package is visible and accessible and an undeployed position in which said article is concealed and inaccessible, wherein said foldable element comprises a front flap and a rear flap, said at least one retractable panel is coupled to but movable relative to at least one of said front flap and rear flap and the article in said package being separate from but adapted to be fixed to said at least one retractable panel, and wherein said front panel incorporates a window providing access to said at least one retractable panel and said at least one retractable panel comprises at least one hinged panel adapted to hinge about a fold line when said package is in a deployed state, said hinged panel being flattened between said front and rear flaps when said package is in an undeployed state.

2. Package according to claim 1, further comprising a cover flap adapted to cover said rear flap so as to strengthen said package.

3. Package according to claim 1, wherein said at least one retractable panel is adapted to be mobile longitudinally between said deployed and undeployed positions in response to combined transverse and longitudinal pressure applied by the user.

4. Package according to claim 1, comprising a plurality of printed surfaces.

5. Package according to claim 1, wherein said at least one hinged panel carries a card containing a plurality of tablets or like medication.

6. Package according to claim 1, wherein said at least one hinged panel carries integral with it information concerning the packaged article.

7. Package for accommodating an article, the package being defined by a single foldable element of sheet material folded into a flat packet, said foldable element of sheet material comprising a retractable flap for carrying the article for displacement between an undeployed position where the article is inaccessible and a deployed or extended position where the article is accessible, a front flap, a rear flap disposed opposite the front flap, the retractable flap being integral with said front and rear flaps and movable with respect thereto so as to prevent complete separation of the retractable flap from the rest of the package when the retractable flap is in its deployed position, the retractable flap having a hinged panel pivotable about a hinge line when the retractable flap is in its deployed position, the retractable flap together with its hinged panel lying flat between the front and rear flaps when the retractable flap is in its undeployed position.

8. Package according to claim 7, wherein an opening is provided in said front flap for access and displacement of said retractable flap.

9. Package according to claim 7, wherein said foldable element further comprises a cover flap adapted to overlie the rear flap and thereby strengthen the package.

10. The package according to claim 9, wherein said retractable flap is responsive to a combination of transverse and longitudinal pressure exerted through the opening for displacement between its undeployed and deployed positions.

11. Package according to claim 10, wherein said opening in said front flap comprises a window.

12. Package according to claim 9, wherein said opening comprises a cut-out in the free edge of the front and rear flaps for grasping the free edge of the retractable flap in the undeployed position.

13. Package according to claim 12, wherein said front, rear, cover and retractable flaps are delimited by respectively parallel transverse fold lines.

14. Package according to claim 7, wherein there are two said retractable flaps aligned with each other, a transverse fold line delimiting said two retractable flaps.

15. Package according to claim 14, wherein said hinged panel pivots about a fold line spaced from said transverse fold line delimiting said retractable flaps.

16. Package according to claim 7, wherein said retractable flap comprises the hinged panel surrounded by a rim, the hinged panel being adapted to traverse an opening in one of said front and rear flaps to permit movement of said retractable flap between said undeployed position and a deployed position in which said hinged panel is oriented at an angle to the general panel of the rim of the retractable flap and the rest of the package.

17. Package according to claim 16, wherein means defining said opening in one of said front and rear flaps defines means for automatically swinging the hinged panel to its angle in the course of displacement of the retractable flap to its deployed position.

18. Package according to claim 16, wherein two said retractable flaps are provided, each having a said hinged panel, and a said opening being provided in each of said front and rear flaps for a respective one of said hinged panels.

19. Package according to claim 18, wherein each said hinged panel is joined to its associated rim by a fold line or hinge, the fold line or hinge defining in cooperation with said means defining the opening in said front panel and said rear panel means for preventing the retractable flaps from separating completely from the rest of the package.

20. Package according to claim 7, wherein said package has a plurality of printed surfaces including said hinge panel.

21. Package according to claim 7, wherein the article is permanently fixed to said retractable flap comprises a card containing a plurality of tablets or like medicament and enclosed by a sealed blister.

22. Package according to claim 21, wherein said hinged panel carries printed matter concerning the characteristics of the packaged article.

23. Package for accommodating an article, the package being defined by a foldable element of sheet material folded into a flat packet, said foldable element of sheet material comprising two aligned retractable flaps for carrying the article therebetween for displacement between an undeployed position where the article is inaccessible and a deployed or extended position where the article is accessible, a front flap and a rear flap disposed opposite the front flap and integrally formed therewith, the retractable flaps being attached to at least one of each front and rear flaps so as to prevent complete separation of the retractable flap from the rest of the package while permitting movement with respect thereto, the retractable flaps having hinged panels adapted to receive therebetween the article and pivotable about hinge lines when the retractable flaps are in their deployed position, the retractable flaps together with their hinged panels lying flat between the front and rear flaps when the retractable flaps are in their undeployed position.

24. Package according to claim 23, wherein a transverse fold line delimits said two retractable flaps.

25. Package according to claim 24, wherein said hinged panels pivot about fold lines spaced from said transverse fold line delimiting said retractable flaps.

26. Package according to claim 25, wherein each of said retractable flaps further comprises a rim surrounding its hinged panel, the hinged panels being adapted to traverse respective openings in said front and rear flaps to permit movement of said retractable flaps between their undeployed position and their deployed position in which said hinged panels are oriented at an angle to the general plane of the rims of the retractable flaps and the rest of the package.

27. Package according to claim 26, wherein means defining said openings in said front and rear flaps defines means for automatically swinging the hinged panels to their angle in the course of displacement of the retractable flaps to their deployed position.

28. Package according to claim 23, wherein each said hinged panel is joined to an associated rim by its hinge line, the hinge line defining in cooperation with said means defining said openings in said front and rear panels means for preventing the retractable flaps from separating completely from the rest of the package.

29. Package according to claim 28, wherein a cut-out is provided in the free edge of the front and rear flaps for grasping the free edge of the retractable flap in the undeployed position.

30. Package according to claim 23, wherein said package has a plurality of printed surfaces including said hinged panel.

31. Package according to claim 23, wherein the article is permanently fixed to said retractable flap comprises a card containing a plurality of tablets or like medicament and enclosed by a sealed blister.

32. Package according to claim 31, wherein said hinged panel carries printed matter concerning the characteristics of the package article.

33. Package according to claim 23, wherein the package is defined by a single foldable element and one of said retractable flaps integrally joined to said flaps.

34. Package according to claim 33, wherein said foldable element further comprises a cover flap adapted to overlie the rear flap and thereby strengthen the package.

35. Package according to claim 33, wherein said retractable flaps are responsive to a combination of transverse and longitudinal pressure exerted through an access opening in the front flap for displacement between its undeployed and deployed positions.

36. Package according to claim 35, wherein said opening in said front flap comprises a window.

* * * * *